US006154555A

United States Patent [19]

Roark

[11] Patent Number: 6,154,555

[45] Date of Patent: Nov. 28, 2000

[54] RECESSED AUDIO SPEAKER SYSTEM

[75] Inventor: Richard S. Roark, Freeport, Ill.

[73] Assignee: Mitek Corporation, Phoenix, Ariz.

[21] Appl. No.: 09/226,473

[22] Filed: Jan. 7, 1999

[51] Int. Cl.[7] ..... H04R 25/00

[52] U.S. Cl. ..... 381/386; 381/388; 181/199

[58] Field of Search ..... 381/386, 388, 381/87, 332, 333, 300, 301, 304; 181/199

[56] References Cited

U.S. PATENT DOCUMENTS 4,516,329 5/1985 Dilcox ..... 33/366

5,758,852 6/1998 Martin ..... 181/199

*Primary Examiner*—Curtis A. Kuntz
*Assistant Examiner*—Phylesha Dabney
*Attorney, Agent, or Firm*—Tod R. Nessle, P.C.

[57] ABSTRACT

A system for installing a audio speaker in a desired orientation in a building construction. The system includes orientation apparatus which is mounted on the audio speaker, is utilized to orient the audio speaker during installation, and is, after the speaker is installed, concealed,

6 Claims, 2 Drawing Sheets

FIG. 3
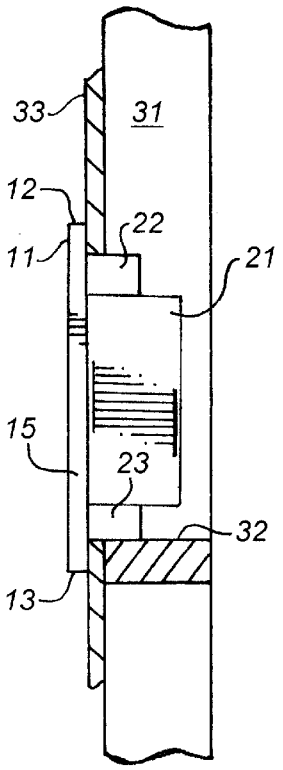
FIG. 2
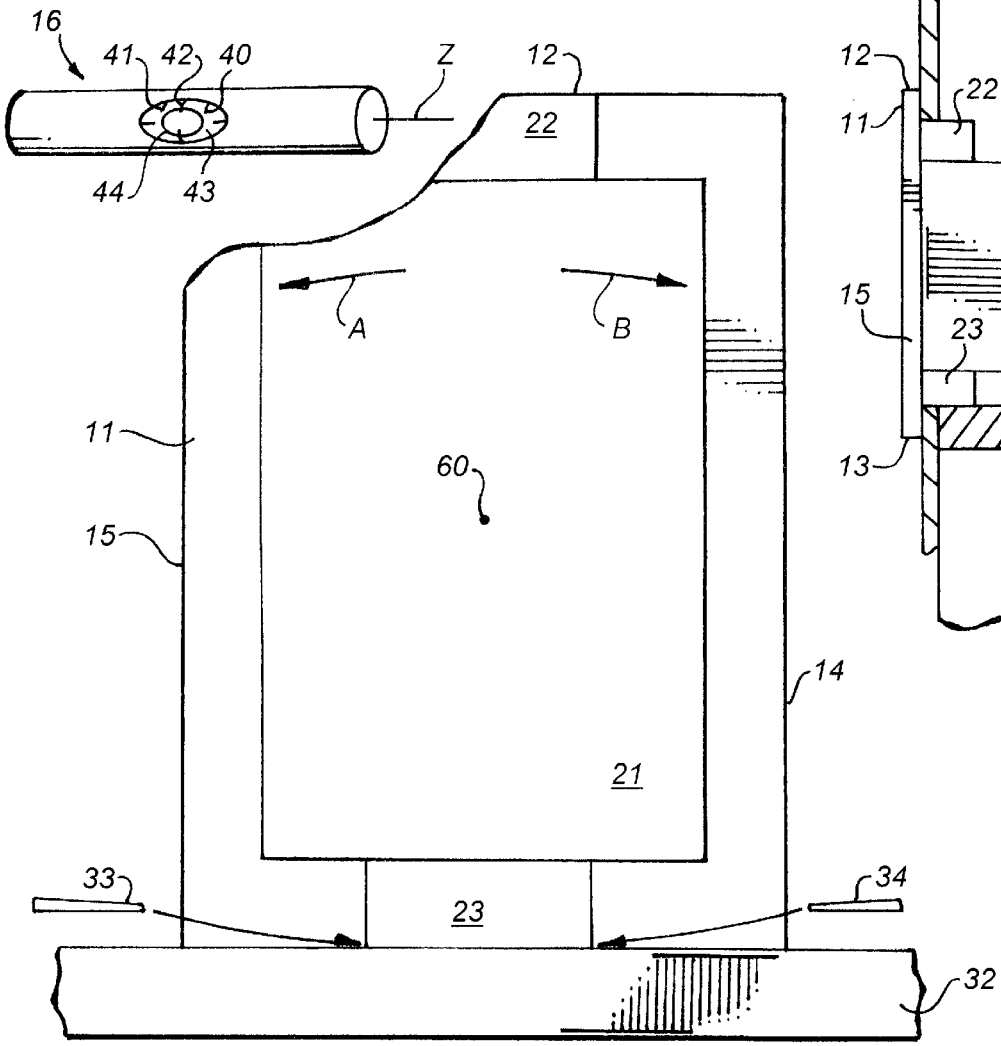
FIG. 4

RECESSED AUDIO SPEAKER SYSTEM

This invention relates to audio speakers.

More particularly, the invention relates to audio speakers which are installed in a building construction.

In a further respect, te invention relates to a system for recessing an audio speaker in a wall, ceiling, floor, or other building construction.

In still a further respect, the invention relates to a system for installing an audio speaker in a desired orientation in a building construction.

An audio speaker is a device that receives a signal and produces sound. The signal received by a speaker typically, but not necessarily, is an electric signal produced by an amplifier. The speaker receives the signal and produces Lyons which produce sound. While the construction of a speaker can vary widely, many speakers include a voice coil, a magnet, and a diaphragm. The voice coil is a coil of wire. The magnet is a permanent magnet. The diaphragm is typically constructed with a piece of paper or plastic and is attached to the coil. The electric signal passes through the voice coil and produces magnetic forces which cause the coil, and therefore the diaphragm, to oscillate in the magnet The oscillation of the diaphragm produces sound waves in the air adjacent the speaker. The sound waves emanate from the speaker. An audio speaker that makes lower-pitched sounds is called a woofer. An audio speaker that makes higher pitched sounds is called a tweeter.

Audio speakers often are mounted in cabinets or other support structures both to protect the speakers and to affect and determine the tonal quality of sounds produced by the speakers.

When an audio speaker is installed in a building structure, it is often desirable to insure that the speaker is in a particular orientation. If, for example, a speaker cabinet includes two or more stacked speakers, the installer may want the stacked speakers or the speaker cabinet parallel or normal to a particular wall to affect the quality of sound produced by a stereophonic or other sound system.

Another instance of when an installer wishes to place a speaker in a desired orientation in a building structure occurs when the speaker is being installed in the framework of the building structure. Although the framework can be fabricated from any desired building material, in many cases it consists of a skeletal structure of two-by-four or two-by-six pieces of lumber. When a speaker cabinet is installed in such a skeletal structure, it is difficult to determine what the appearance and orientation of the cabinet with respect to the walls, ceiling, and floors of the building structure will be when paneling and sheet rock are attached to the wood skeletal structure to finish the building structure.

Another reason an installer may wish to place a speaker cabinet or other support structure in a selected orientation is to insure that the outer edges or some other portion of the cabinet is in a particular aesthetically pleasing orientation with respect to the floor, wall(s), ceiling, or juncture of the same in a room in a building structure.

Conventional procedures for orienting an audio speaker cabinet or other support structure during installation consist of (1) positioning the cabinet "by sight", i.e. the installer steps back and by sight makes a judgment as to whether the cabinet is properly positioned, (2) insuring that a rectangular or square cabinet is "square" with the two-by-four(s) on which the cabinet is mounted, and (3) measuring from each of two points on a flat side of the cabinet to the floor or to a comer to insure that each of the two points is equidistant from the floor or from the comer. There are disadvantages associated with these procedures. Namely, positioning by sight is typically only an approximation at best; insuring that a cabinet is square with the two-by-four(s) or other structural member on which the cabinet is mounted may not work if the two-by-four is canted with respect to the ceiling, floor, etc.; and, measuring from the sides of the cabinet can be inaccurate if the two points are close together or if a measuring tape is being used to span a long distance from the points to a comer in a room. Accordingly, it would be highly desirable to provide an improved apparatus and system for mounting an audio speaker in a desired orientation in a structure.

Therefore, it is a principal object of the invention to provide an improved audio speaker.

Another object of the invention is to provide an improved audio speaker which facilitates positioning the speaker in a desired orientation.

A further object of the invention is to provide an improved apparatus and method for orienting an audio speaker in a building structure with respect to a reference line which is spaced apart from the audio speaker.

Still another object of the invention is to provide an improved apparatus and method for orienting an audio speaker in a building structure to optimize the aesthetic effect and tonal qualities of the speaker.

These and other, further and more specific objects and advantages of the invention will be apparent to those skilled in the art from the following detailed description thereof, take in conjunction with the drawings, in which:

FIG. 2 illustrates an orientation apparatus mounted on the audio speaker of FIG. 1;

FIG. 3 is a side section view of the audio speaker of FIG. 1 further illustrating construction features of the invention; and, FIG. 4 is a back view of the audio speaker of FIG. 1 illustrating construction details thereof and illustrating the use of shims to alter the orientation of the speaker.

Figure 1:
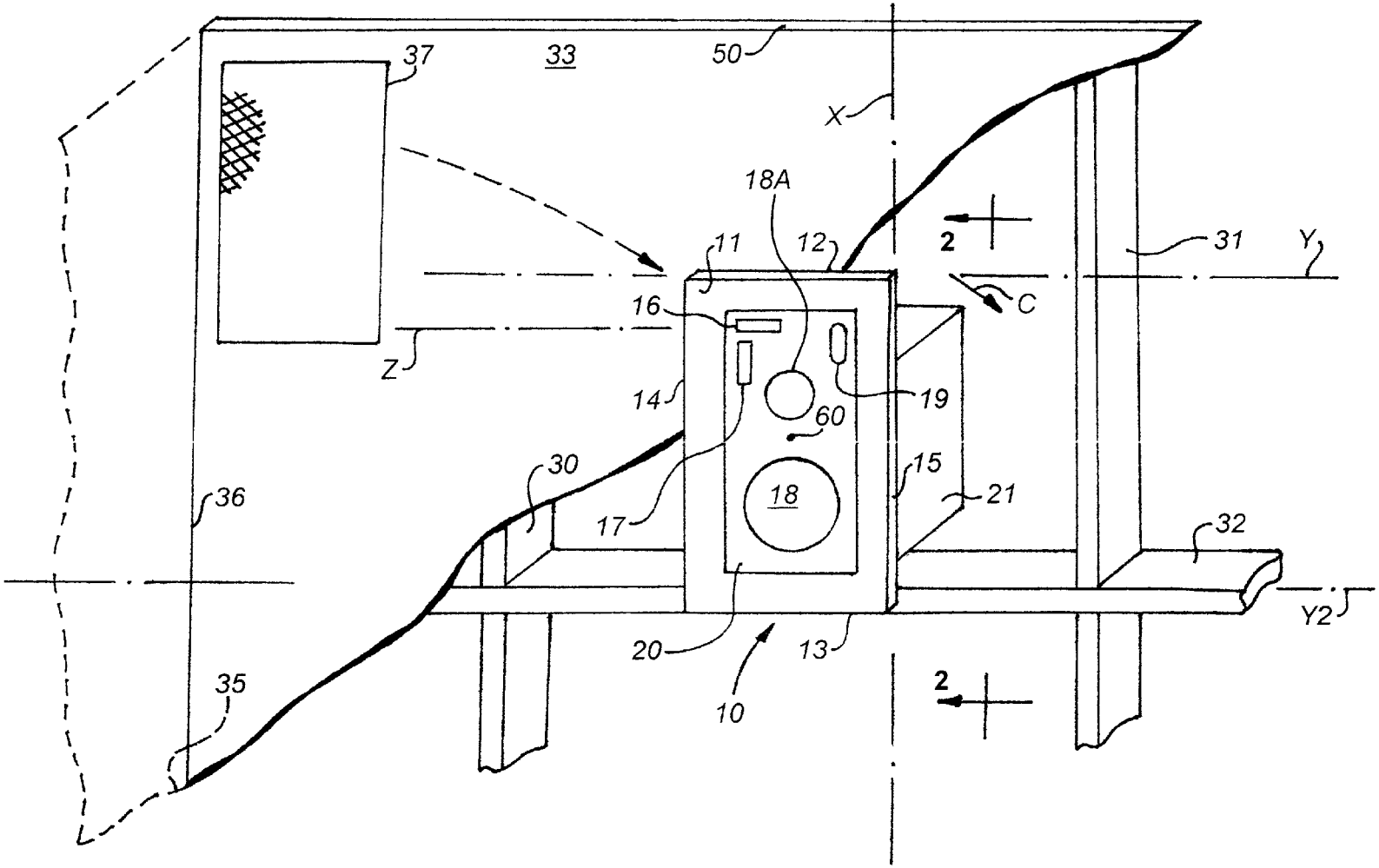
FIG. 1 illustrates an audio speaker mounted in a building structure in accordance with the principles of the invention.

Briefly, in accordance with my invention, I provide an unproved audio per system including a support structure; sound producing apparatus mounted in the support structure for receiving signals and producing vibrations which produce sound waves which emanate from the speaker; and, apparatus mounted on the audio speaker system for determining if the speaker system is in a selected orientation.

In another embodiment of my invention, I provide improvements in combination with a building structure. The improvements consist of an audio speaker system for installation in the building structure. The audio speaker system includes a reference line; a support structure; sound producing apparatus mounted in the support structure for receiving signals and producing vibrations which produce sound waves which emanate from the sound producing apparatus; and, apparatus mounted on the audio speaker system in a selected orientation with respect to said reference line for mounting the support structure is in a desired orientation in the building structure.

In a further embodiment of my invention, I provide an improved method for recessing an audio speaker system in a building structure. The improved method includes the step of providing sound production apparatus. The sound production apparatus includes a support structure; sound producing equipment mounted in the support structure for receiving signals and producing vibrations which produce sound waves which emanate from the sound producing equipment; and, orientation apparatus mounted on the sound production apparatus for positioning the support structure in a selected orientation with respect to a selected reference line in the building structure. The improved method also includes the steps of recessing the sound production apparatus in the building structure; and, utilizing the orientation apparatus to position the support structure in the selected orientation with respect to the selected reference line.

Turing now to the drawings, which depict the presently preferred embodiments of the invention for purpose of illustrating the invention and not by way of limitation of the scope of the invention, and in which like reference characters refer to corresponding elements throughout the several views, FIG. 1 illustrates an audio speaker system, generally indicated by reference character 10, mounted in a building structure comprising a wall. The building structure in which audio speaker system 10 is mounted can, in addition to a wall, comprise a ceiling, a floor, a residential building, a commercial building, or a free-standing construction in a residential or commercial building.

The wall of FIGS. 1, 3 and 4 includes a wood frame or skeleton fabricated with two-by-four pieces of lumber 30, 31 and 32; and, includes sheetrock 33 attached to the wood frame. The wall including sheet rock 33 is normal to and co-terminates with another wall 35 to form vertically oriented corner 36. Reference line or axis $Y_2$ extends along two-by-four 32, is parallel to axis Y, and is normal to corner 36. Reference line or axis Y extends along edge 12. Reference line or axis X extends along edge 15 and is perpendicular to reference lines Y and $Y_2$ and to axis Z.

Audio speaker system 10 has a support structure including rectangular face plate 20 attached to rectangular frame 11 which circumscribes plate 20. At least one speaker 18, 18A is mounted in face plate 20 and inside a hollow housing which includes stacked orthogonal members 22, 21, 23. Frame 11 includes parallel peripheral edges 12 and 13 and parallel peripheral edges 14 and 15. Edges 14 and 15 extend between edges 12 and 13.

Orientation apparatus is mounted on speaker system 10 to determine if the support structure or speaker(s) are in a desired orientation. One such orientation apparatus comprises conventional bubble levels 16 and 17. Bubble level 17 is identical to level 16 except that in FIG. 1 level 16 is horizontally oriented and level 17 is vertically oriented. The longitudinal axis Z of level 16 is parallel to reference lines Y and $Y_2$ and to the upper horizontal edge 50 of sheet rock 33. Edge 50 co-terminates with the ceiling (not visible) to form a horizontally oriented corner at the wall-ceiling juncture.

Bubble level 16 includes a hollow cylindrical housing having an elongate centerline Z and a transparent oval window 43 for viewing the bubble 44. Gradations or rulings 40 to 42 are formed on window 43. When bubble 44 is centered on gradation 42 level 16 (or 17) is horizontally oriented.

Bubble level 16 is utilized when system 10 is installed in the orientation illustrated in FIG. 1, i.e. bubble level 16 is utilized when edge 13 is intended to be parallel to the ground after system 10 is installed. Bubble level 17 is utilized when system 10 is installed in an orientation rotated ninety degrees from the orientation illustrated in FIG. 1, i.e. bubble level 17 is utilized when edge 15 is intended to be parallel to the ground after system 10 is installed.

Another orientation apparatus mounted in face plate 20 is sensor unit 19. Sensor unit 19 includes a gyroscope or other apparatus for determining the orientation of the support structure and/or speakers in the audio speaker system 10 and for producing signals which inform an installer how close the system 10 is to a desired orientation. Sensor unit 19 can produce visual signals, audible signals, or other signals to provide an installer with information concerning the orientation of system 10. By way of example and not limitation, sensor unit 19 can include a microprocessor which is programmed so that the orientation of system 10 shown in FIG. 1 is the desired installed orientation. If system 10 is tilted such that edge 12 and the support structure tilt in the direction of arrow C in FIG. 1 to the right through an arc a distance of four degrees from the desired vertical orientation depicted in FIG. 1, the microprocessor processes sensor signals which indicate that system 10 is so tilted and then the microprocessor causes a visual display to read "Tilt to left 4°". If the installer then tilts system 10 four degrees in a direction opposite that indicated by arrow C, the microprocessor evaluates new sensor signals which indicate system 10 is properly vertically oriented. The microprocessor then causes the visual display to read "System centered. Do not adjust."

Rectangular fabric cover 37 is mounted over face plate 20 and covers all or most of face plate 20 so that bubble levels 16 and 17, sensor unit 19, and speakers 18 and 18A are covered by cover 37 and cannot be seen or cannot be readily seen by a person through cover 37. Cover 37 ordinarily is installed only after the support structure is oriented and fixed in a selected recessed position in a wall or other building structure in the manner illustrated in FIG. 1.

In use, the audio speaker system 10 of FIG. 1 is provided. A rectangular opening is cut through sheetrock 33. The fabric cover 37 is removed so &a bubble level 16 and/or sensor 19 is visible. The system 10 can be positioned at any desired location in a building structure. However, in this example, system 10 is inserted through the opening cut in the sheetrock and is set on two-by-four 32 in the position shown in FIG. 1, with members 21 to 23 extending and recessed from sheetrock 33 into the two-by-four wall framework. Electrical wires (not shown) are attached to system 10 in conventional fashion to supply the signal which is processed by system 10 to produce sound which emanates outwardly from audio speakers 18 and 18A. The installer visually examines level 16 (or sensor 19) to determine if system 10 is properly oriented and reference lines or axes Z, Y, and $Y_2$ are parallel. If bubble 44 is not centered on rule 42, then shims 33 and/or 34 are inserted intermediate member 23 and two-by-four 32 to tilt appropriately the support structure of system 10 in order to center bubble 44 on rule 42. Shim 33 functions to tilt the support structure in the direction of arrow B (FIG. 4). Shim 34 functions to tilt the support structure in the direction of arrow A Once system 10 is so adjusted and fixed in position, cover 37 is installed over faceplate 20 to conceal levels 16 and 17, sensor unit 19, and speakers 18A and 18. Any other desired means can be utilized in addition to or in conjunction with shims 33, 34 to adjust system 10 to a desired orientation.

As would appreciated by those of sill in the art, system 10 can be installed in a two-by-four framework or other framework before the framework is "finisied". The framework is finished by applying sheetrock, paneling, paint, molding, etc. In fact, one virtue of the invention is that it permits system 10 to be installed accurately in a desired orientation before the finish work is done on a building under construction. When the desired orientation is like the one illustrated in FIG. 1, then when the finish work is completed the peripheral edges 12 to 15 preferably are each parallel or perpendicular to comer 36 and edge 50 so that system 10 is in an orientation which is aesthetically pleasing to the eye.

Bubble levels can be utilized to position system 10 in a canted orientation with respect to any selected reference line in a building structure. For example, if wall 35 and corner 36 are not perfectly vertical, but are instead canted 3° to the left in FIG. 1, the left hand edge 14 can be placed against, parallel to, and flush with wall 35. Bubble 44 will not be centered on rule 42, but will be slightly to the right of rule 42 and will instead, for example, be centered on rule 40. In order to insure that edge 14 is parallel to comer 36 when system 10 is installed, the installer places system 10 on two-by-four 32 in the position shown in FIG. 1 and utilizes a shim 33 between member 23 and two-by-four 32 to tilt slightly the support structure of system 10 in the direction of arrow B (to the right when viewing system 10 from behind in FIG. 4, but to the left when viewing system 10 from the front in FIG. 1) until the bubble 44 is centered on rule 40. System 10 is then fixed in position with bubble 44 centered on rule 40.

A bubble level 16, 17 need not be mounted on system 10 so the bubble level is parallel or perpendicular to the edges 12 to 15. If, for example, it is desired to install system 10 in the wall of FIG. 1 so that reference line X (and edge 15, edge 12, edge 13, edge 14, reference line Y) is canted at 45° from vertical comer 36 or from vertically oriented two-by-four 31, then a level 16 is permanently affixed to or in face plate 20 in a canted orientation such that axis Z is at an angle of 45° with respect to each of edges 12 to 15. When system 10 is installed, the installer insures that level 16 is horizontally oriented and that bubble 44 is centered on rule 42. This insures that system 10 is canted in the wall at 45° from the orientation shown in FIG. 1. Brackets or any other desired prior art fastener/fixing apparatus is used to fix system 10 in its canted 45° orientation (or in any other desired orientation). Consequently, as can be readily seen, a level 16, 17 (or sensor unit 19) can be oriented on system 10 to facilitate mounting an audio speaker system 10 at any desired angle or orientation in or on a wall or other building structure.

As described above, bubble level 16 is utilized to mount an audio speaker system in a two dimensional position or orientation. A two dimensional position is achieved by rotating the er system of FIG. 4 about an axis which is normal to the sheet of the paper on which the drawings are inscribed and which passes through the center 60 of system 10. In other words, the various possible orientations of system 10 can each be attained by rotating system 10 about one axis (the axis normal in FIG. 4 to the sheet of the paper on which FIG. 4 is inscribed) while edges 12 to 15 remain in one plane, the plane defined by the sheet of par on which FIGS. 1 to 4 are inscribed. As would be appreciated by those of skill in the art, a sensor unit 19 or plurality of bubble levels can be utilized which will permit the spatial (in three dimensions) positioning of system 10 in a building structure. In spatial positioning, a desired spatial orientation of system 10 is attainable by rotating system 10 about any or all of the X, Y and Z axes, which axes are each normal to the two remaining axes.

When a bubble level 16, 17 is utilized, the level is fixedly secured to system 10 in a selected orientation with respect to at least one reference line on the support structure of system 10, In FIG. 1, level 16 is affixed to face plate 20 in a position in which axis Z is parallel to reference line Y and is normal to reference line X.

The shape and dimension of speakers 18 and 18A, and of frame 11 and other portions of the support structure can vary as desired, as can the position of speakers 18 and 18A on the support structure.

Having described my invention in such terms as to enable those skilled in the art to understand and practice it, and having identified the presently preferred embodiments thereof, I claim:

1. In combination with a building structure, the improvements consisting of an audio speaker system for mounting in said building structure, said audio speaker system including (a) a support structure;

(b) sound producing means mounted in said support structure for receiving signals and producing vibrations which produce sound waves which emanate from said sound producing means;

(c) at least one reference line;

(d) first means mounted on said audio speaker system in a selected orientation with respect to said reference line to mount said support structure in a first desired orientation in said building structure; and, (e) second means mounted on said audio speaker system in a selected orientation with respect to said reference line to mount said sup-port structure in a second desired orientation in said building structure.

2. The combination of claim 1 wherein said first and second means each comprise at least one bubble level.

3. A method for recessing an audio speaker system in a building structure, including the steps of (a) providing sound production means including
a support structure,
a cover to be mounted on said support structure,
sound producing means mounted in said support structure for receiving signals and producing vibrations which produce sound waves which emanate from said sound producing means, and
orientation means mounted on said sound production means for positioning said support structure in a selected orientation with respect to a selected reference line in said building structure;

(b) recessing said sound production means in said building structure;

(c) viewing and utilizing said orientation means to position said support structure in said selected orientation with respect to said selected reference line; and, (mounting said cover on said support structure over said orientation means to conceal said orientation means from view.

4. The method of claim 3 wherein said orientation means comprises at least one bubble level.

5. A method for recessing an audio speaker system in a building structure, including the steps of (a) providing sound production means including
a support structure,
a cover to be mounted on said support structure,
sound producing means mounted in said support structure for receiving signals and producing vibrations which produce sound waves which emanate from said sound producing means, and
orientation means mounted on said sound production means for positioning said support structure in a selected orientation with respect to a selected reference line in said building structure;

(b) recessing said sound production means in said building structure; and, (c) viewing and utilizing said orientation means to position said support structure in said selected orientation with respect to said selected reference line.

6. The method of claim 5 wherein said orientation means comprises at least one bubble level.

* * * * *